US010351990B2

(12) United States Patent
Yu

(10) Patent No.: US 10,351,990 B2
(45) Date of Patent: Jul. 16, 2019

(54) DRYER APPLIANCE AND METHOD OF OPERATION

(71) Applicant: Haier US Appliance Solutions, Inc., Wilmington, DE (US)

(72) Inventor: Zhiquan Yu, Mason, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 326 days.

(21) Appl. No.: 15/350,162

(22) Filed: Nov. 14, 2016

(65) Prior Publication Data

US 2018/0135235 A1 May 17, 2018

(51) Int. Cl.
*D06F 58/28* (2006.01)

(52) U.S. Cl.
CPC ..... *D06F 58/28* (2013.01); *D06F 2058/289* (2013.01); *D06F 2058/2861* (2013.01); *D06F 2058/2864* (2013.01)

(58) Field of Classification Search
CPC ..... D06F 2058/289; D06F 2058/2864; D06F 2058/286; D06F 58/28; D06F 2058/2861
See application file for complete search history.

(56) References Cited

U.S. PATENT DOCUMENTS

| | | | | |
|---|---|---|---|---|
| 7,975,401 | B2 | 7/2011 | Beaulac | |
| 8,661,706 | B2 | 3/2014 | Bellinger | |
| 2011/0138542 | A1* | 6/2011 | Ji | D06F 39/008 8/137 |
| 2011/0153086 | A1* | 6/2011 | Bellinger | D06F 58/28 700/275 |
| 2014/0060595 | A1* | 3/2014 | Alexander | D06F 39/005 134/56 R |
| 2016/0076193 | A1 | 3/2016 | Santillan Galvan | |

FOREIGN PATENT DOCUMENTS

| | | | | |
|---|---|---|---|---|
| DE | 4411958 | A1 | 10/1995 | |
| WO | WO-2014191247 | A1 * | 12/2014 | D06F 58/28 |

* cited by examiner

*Primary Examiner* — David J Laux
(74) *Attorney, Agent, or Firm* — Dority & Manning, P.A.

(57) ABSTRACT

A dryer appliance and method of operation are generally provided. The dryer appliance may include a drying chamber, an air passage in fluid communication with the drying chamber, and a heater in thermal communication with the drying chamber. The method may include motivating an airflow through the drying chamber and the air passage. The method may include measuring a velocity of the airflow through the air passage. Also included may be determining an article load size within the drying chamber based on the measured velocity, and directing a power output at the heater based on the determined article load size.

16 Claims, 6 Drawing Sheets

DRYER APPLIANCE AND METHOD OF OPERATION

FIELD OF THE INVENTION

The present subject matter relates generally to dryer appliances, and more particularly to dryer appliances including features and methods for determining a load size.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Typical dryer appliances also generally include a heating assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler (such as a blower) is utilized to flow the internal air from the vent duct to the exhaust duct. When operating, a blower may pull air through itself from the vent duct, and this air may then flow from the blower to the exhaust conduit.

Consumer demand and regulation have increased the need for energy efficient appliances. Moreover, decreased energy consumption is generally advantageous. This is especially true for dryer appliances, which may be one of the primary energy consumption sources within a home. Specifically, the heating assembly may consume a relatively large amount of energy. Some appliances provide for a heating assembly that can vary heat or energy output setting according to certain properties (e.g., size) of the overall load of articles placed within the drum. A suitable heat or energy setting may ensure that the heating assembly does not operate for too long or at too high of a setting, thus minimizing energy consumption. However, when operating the dryer appliance, it may be difficult to determine the correct heat or energy output setting for the heating assembly. Many users are unable to correctly evaluate properties such as load size. Although some existing systems provide features for determining load size, for example, by solely monitoring temperature changes within the drum, such systems may be inaccurate under certain conditions. Further systems may be undesirably complex and/or difficult to implement, thus increasing their reliability and the overall cost of the dryer appliance.

As a result, it would be advantageous to provide a dryer appliance that could automatically (e.g., without a user estimation or input) determine a load size of articles within a drum. It would be further advantageous to provide a dryer appliance that could make such determinations accurately, reliably, and inexpensively. Moreover, energy consumption may be advantageously reduced if such a system could automatically control a heat or energy output based on such load size determinations.

BRIEF DESCRIPTION OF THE INVENTION

Aspects and advantages of the invention will be set forth in part in the following description, or may be obvious from the description, or may be learned through practice of the invention.

In one aspect of the present disclosure, a method for controlling a dryer appliance is provided. The dryer appliance may include a drying chamber, an air passage in fluid communication with the drying chamber, and a heater in thermal communication with the drying chamber. The method may include motivating an airflow through the drying chamber and the air passage. The method may include measuring a velocity of the airflow through the air passage. Also included may be determining an article load size within the drying chamber based on the measured velocity, and directing a power output at the heater based on the determined article load size.

In another aspect of the present disclosure, a dryer appliance is provided. The dryer appliance may include a cabinet, a drum, an air passage, an air handler, a heating assembly, an airflow sensor, and a controller. The drum may be rotatably mounted within the cabinet, the drum defining a drying chamber. The air passage may be in fluid communication with the drying chamber. The air handler may be attached in fluid communication with the drying chamber to motivate an airflow therethrough. The heating assembly may be attached to the drum in thermal communication with the drying chamber. The airflow sensor may be disposed in fluid communication with the air passage to detect the airflow. The controller may be operatively connected to the air handler, the heating assembly, and the airflow sensor. The controller may be configured to initiate a load-contingent cycle. The load-contingent cycle may include motivating an airflow through the drying chamber and the air passage, measuring a velocity of the airflow through the air passage from the airflow sensor, determining an article load size within the drying chamber based on the measured velocity, and directing a power output at the heating assembly based on the determined article load size.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
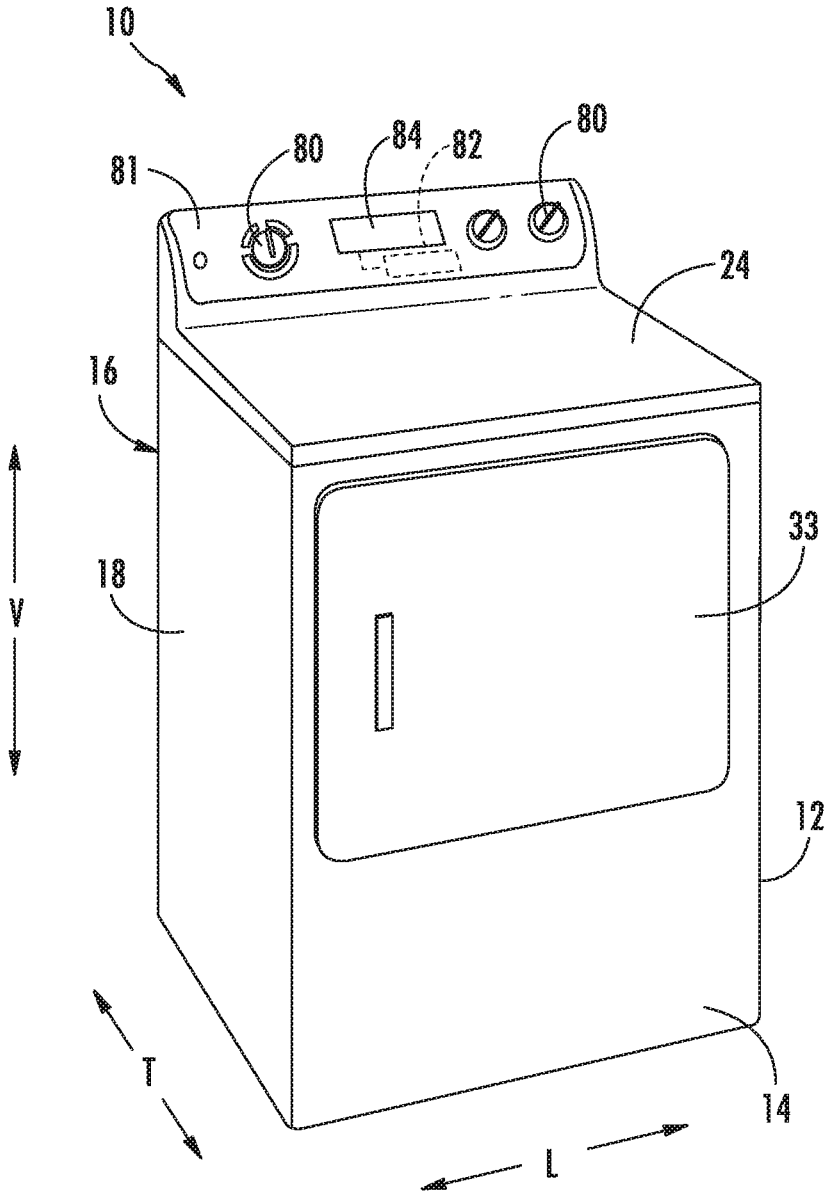
FIG. 1 provides a perspective view of a dryer appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
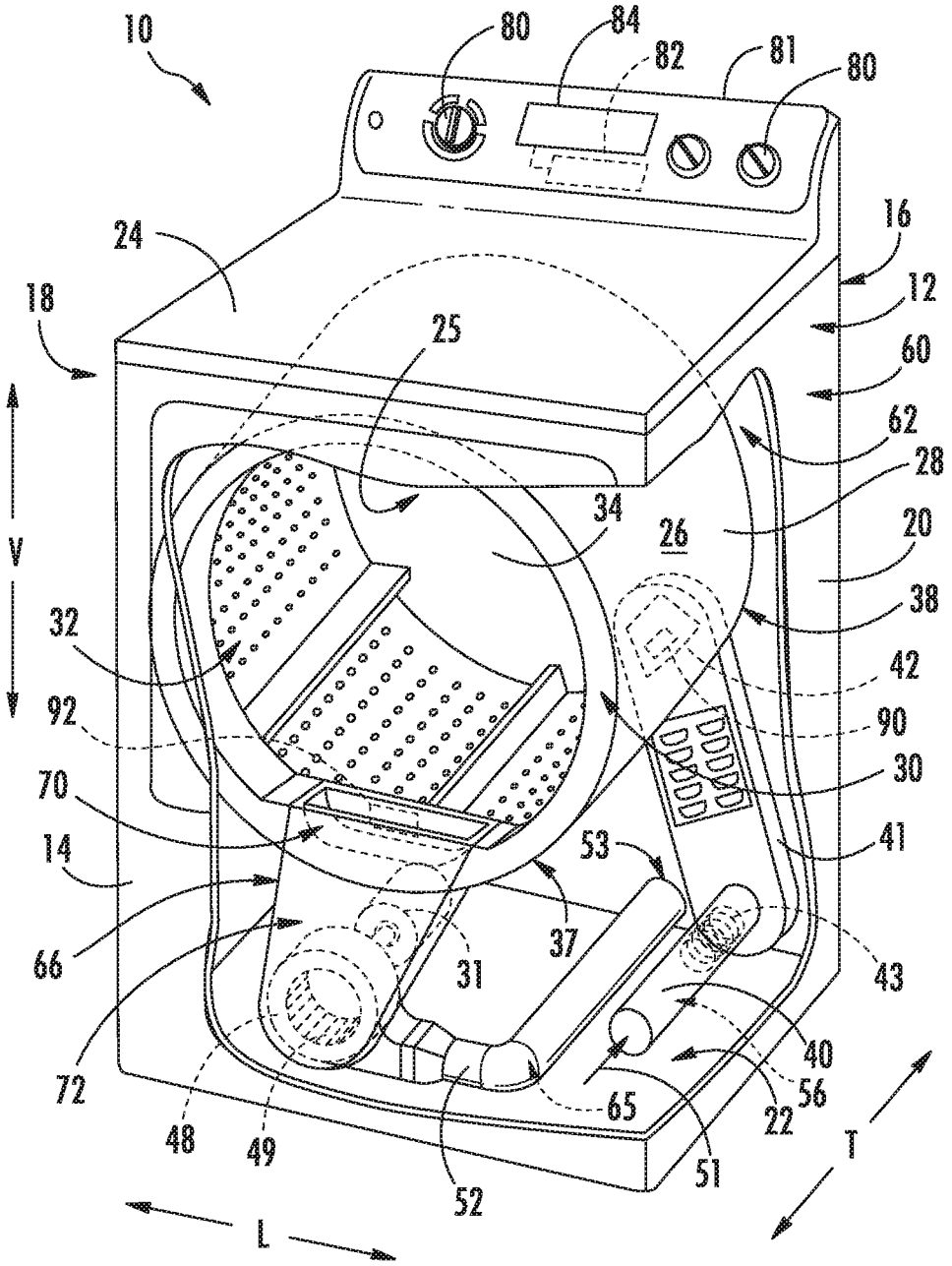
FIG. 2 provides a perspective view of the example dryer appliance of FIG. 1 with portions of a cabinet of the example dryer appliance removed to reveal certain components of the example dryer appliance.
Figure 3:
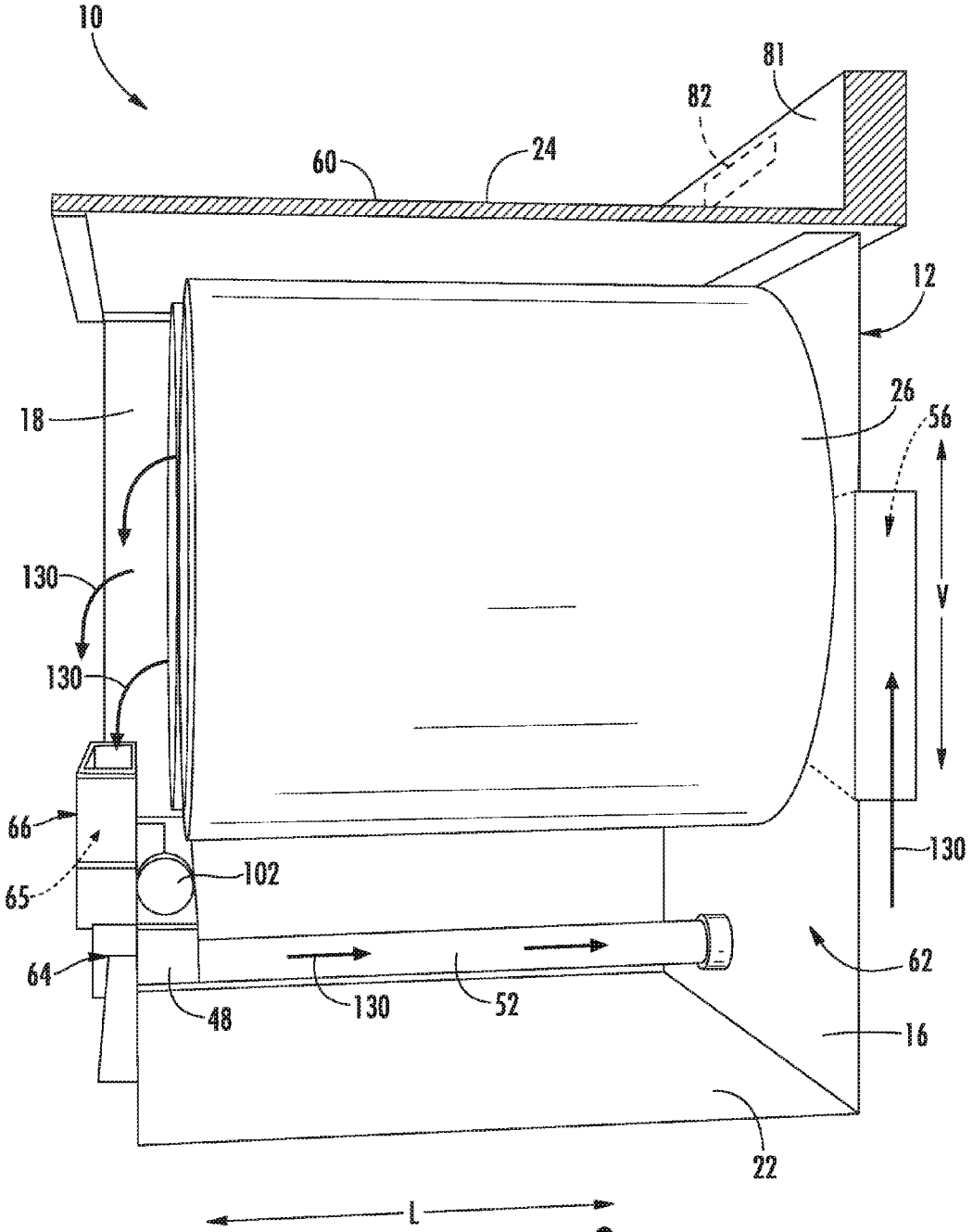
FIG. 3 provides a side schematic view of various components of a dryer appliance in accordance with the example dryer appliance of FIG. 2.

FIG. 1 illustrates a dryer appliance 10 according to an example embodiment of the present subject matter. FIG. 2 provides another perspective view of dryer appliance 10 with a portion of a cabinet or housing 12 of dryer appliance 10 removed in order to show certain components of dryer appliance 10. FIG. 3 provides a side schematic view of dryer appliance 10, and illustrates an airflow therethrough. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the transverse direction T. In example embodiments, drum 26 is rotatable, e.g., about an axis that is parallel to the transverse direction T, within cabinet 12.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

An air handler 48, such as a blower or fan, may be provided to motivate an airflow 130 (FIG. 3) through air passages 56, 65. Specifically, air handler 48 may include a motor 31 may be in mechanical communication with a blower fan 49, such that motor 31 rotates blower fan 49. Air handler 48 is configured for drawing air through chamber 25 of drum 26, e.g., in order to dry articles located therein, as discussed in greater detail below. In alternative example embodiments, dryer appliance 10 may include an additional motor (not shown) for rotating fan 49 of air handler 48 independently of drum 26.

Drum 26 may be configured to receive heated air that has been heated by a heating assembly 40, e.g., in order to dry damp articles disposed within chamber 25 of drum 26. Heating assembly 40 includes a heater 43 that is in thermal communication with drying chamber 25. Specifically, heater 43 may be a variable heat output heater that includes one or more electrical resistance heating elements or gas burners, for heating air. As discussed above, during operation of dryer appliance 10, motor 31 rotates fan 49 of air handler 48 such that air handler 48 draws air through chamber 25 of drum 26. In particular, ambient air enters an air entrance passage defined by heating assembly 40 via an entrance 51 due to air handler 48 urging such ambient air into entrance 51. Such ambient air is heated within heating assembly 40 and exits heating assembly 40 as heated air. Air handler 48 draws such heated air through an air entrance passage 56, including inlet duct 41, to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air flows in turn from chamber 25 through an outlet assembly 64 positioned within interior 62. Outlet assembly 64 generally defines an air exhaust passage 65 and includes a vent duct 66, air handler 48, and an exhaust conduit 52. Exhaust conduit 52 is in fluid communication with vent duct 66 via air handler 48. During a dry cycle, internal air flows from chamber 25 through vent duct 66 to air handler 48, e.g., as an outlet airflow 130. As shown, air further flows through air handler 48 and to exhaust conduit 52. The internal air is exhausted from dryer appliance 10 via exhaust conduit 52.

In example embodiments, vent duct 66 can include a filter portion 70 and an exhaust portion 72. Exhaust portion 72 may be positioned downstream of filter portion 70 (in the direction of airflow of the internal air). A screen filter of filter portion 70 (which may be removable) traps lint and other particulates as the internal air flows therethrough. The internal air may then flow through exhaust portion 72 and air handler 48 to exhaust conduit 52. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM). The memory elements can store information accessible processing device, including instructions that can be executed by processing device. Optionally, the instructions can be software or any set of instructions that when executed by the processing device, cause the processing device to perform operations. For certain embodiments, the instructions include a software package configured to operate appliance 10 and execute certain cycles (e.g., load-contingent cycle). For example, the instructions may include a software package configured to execute the example methods 600 and 700 described below with reference to FIGS. 6 and 7, respectively.

In some embodiments, dryer appliance 10 also includes one or more sensors. For example, dryer appliance 10 may include an airflow sensor 90. Airflow sensor 90 is generally operable to detect the velocity of air (e.g., as an air flow rate in meters per second, or as a volumetric velocity in cubic meters per second) as it flows through the appliance 10. Generally, airflow sensor 90 is at least partially positioned within air passage 56 or 65 to detect airflow 130. In some embodiments, airflow sensor 90 is positioned within inlet duct 41, e.g., at or proximal to an inlet of drum 26. Additionally or alternatively, airflow sensor 90 may be positioned at another suitable location, such as within exhaust conduit 52, vent duct 66, and/or another portion of inlet duct 41. Airflow sensor 90 may be embodied by any suitable configuration, such as a Pitot tube or a set of dual static-pressure taps connected to a pressure transducer. When assembled, airflow sensor 90 may be in communication with (e.g., electrically coupled to) controller 82, and may transmit readings to controller 82 as required or desired.

Dryer appliance 10 may further include, for example, one or more temperature sensors 92. Temperature sensor 92 is generally operable to measure internal temperatures in dryer appliance 10. In some embodiments, temperature sensor 92 is disposed proximal to an outlet of drum 26 (e.g., within vent duct 66). Additionally or alternatively, temperature sensor 92 may be disposed in drum 26, such as in chamber 25 thereof, or in any other suitable location within dryer appliance 10. When assembled, temperature sensor 92 may be in communication with controller 82, and may transmit readings to controller 82 as required or desired.

In some embodiments, controller 82 is configured to detect a load size within drum 26 based on one or more sensor signals from the sensors 90, 92. For instance, controller 82 may automatically determine the mass, weight, and/or volume of articles placed within drying chamber 25 without an estimation or input from a user. During use, controller 82 can initiate a load-contingent cycle wherein a determination about the load (e.g., of the mass, weight, and/or volume of articles within drying chamber 25) is made, and operation of the appliance 10 is modified accordingly.

As an example, controller 82 may initiate or perform a load-contingent cycle to determine a load size of articles within drying chamber 25 using information concerning airflow through appliance 10. It is understood that "article load size" may generally correspond to a qualitative or quantitative characteristic of the overall load of articles within drying chamber 25. For instance, an article load size may be selected from multiple generic load sizes that may be provided, including a small load size, medium load size, and large load size. The generic load sizes may generally correspond to a relative distinction based on mass, weight, and/or volume. Additionally or alternatively, an article load size may be one or more values of the overall load properties. For instance, value(s) of the mass, weight, and/or volume of articles within drying chamber 25 may be included in article load size.

In some embodiments, controller 82 may measure the velocity of airflow, e.g., airflow through inlet duct 41, based on signals received from airflow sensor 90. For instance, during certain operations wherein one or more articles are placed within drum 26, controller 82 may activate air handler 48 to motivate airflow 130 through the air passages 56, 65. As airflow 130 continues to pass over airflow sensor 90, controller 82 may receive one or more signals from airflow sensor 90. It is understood that the signals, e.g., the voltage from airflow sensor 90, may vary according to the intensity or magnitude of air velocity. According to the signals, velocity may thus be measured, e.g., within controller 82. Optionally, heater 43 may be activated to generate heat during the collection of the signals (e.g., during measurement of the velocity). Alternatively, heater 43 may be maintained in an inactive state, such that no heat is generated therein, during the collection of the signals.

Once the measured velocity is generated, controller 82 may use the measured velocity to determine an article load size. Optionally, the measured velocity may be compared to a baseline velocity. The baseline velocity may be representative of the airflow velocity through appliance 10 when drying chamber 25 is empty (i.e., contains no foreign non-appliance articles for drying). Thus, in some such embodiments, controller 82 establishes a baseline velocity before articles are placed within drying chamber 25. In other words, the baseline velocity may be premeasured before article-drying operations. In obtaining premeasured airflow velocity, air handler 48 may be activated and at least one signal may be received from airflow sensor 90 while drying chamber 25 is empty. The signal received while drying chamber 25 is empty may be utilized (e.g., measured by controller 82) to establish the baseline velocity.

Figure 4:
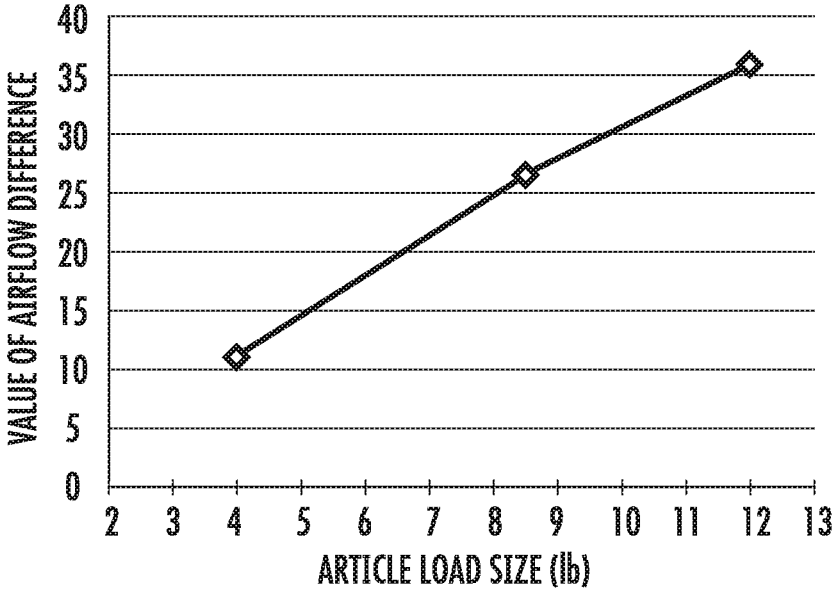
FIG. 4 provides an example predeveloped model establishing a relationship between an airflow difference value and a probable size of an article load.

The baseline velocity may be stored within controller 82 (e.g., at a memory unit) and compared to the measured velocity that is generated after articles are placed within drying chamber 25. In certain embodiments, controller 82 determines the difference (e.g., as a value of magnitude) between the baseline velocity and the measured velocity. Controller 82 may appraise the article load size according to the difference value. Specifically, controller 82 may compare the difference value to one or more predetermined airflow data. As illustrated in FIG. 4, the predetermined airflow data may establish a relationship between the difference value and the probable size of the article load (e.g., as a predeveloped database, chart, model, or algorithm tracking an airflow difference value to an article load size value). For instance, a predeveloped model created through experimentation of a representative appliance (e.g., an appliance of the same size and configuration as appliance 10) may be stored within controller 82. The difference value determined by controller 82 may then correspond to a specific appraised article load size (e.g., article weight). Advantageously, the appraised article load size may be a more accurate representation of the actual load size than would be possible using existing methods, such as solely measuring changes in temperature.

In some embodiments, the appraised article load size may be used as the sole value for the controller's determination of the article load size. In alternative embodiments, multiple appraisals may be compared in determining the article load size. As an example, an appraised article load size made using airflow velocity (e.g., as described above) may be a primary appraisal. A secondary appraisal of the article load size may be generated from information or signals at another sensor.

For example, controller 82 may generate a secondary appraisal based on a temperature derivative within appliance 10. Specifically, the derivative may be a change in temperature detected at temperature sensor 92. In some such embodiments, after articles are placed within drum 26, controller 82 may activate air handler 48 to motivate airflow 130 through the air exhaust passage 65 and heating assembly 40. Heater 43 is further activated to supply heat to drum 26. Drum 26 may optionally be rotated. Articles within drum 26 may contact temperature sensor 92, and controller 82 may receive one or more signals from temperature sensor 92. Specifically, controller 82 may receive a first temperature signal at a first time and a second temperature signal at a second time (e.g., a later or subsequent time). In other words, controller 82 receives two temperature signals over a span of time. Optionally, the span of time (i.e., the span between the first time and the second time) may be between thirty (30) seconds and one hundred-twenty (120) seconds. In certain embodiments, the span of time is between fifty five (55) seconds and sixty five (65) seconds.

It is understood that the signals, e.g., the voltage from temperature sensor 92, may vary according to the temperature at temperature sensor 92. According to the signals, temperature may thus be measured, e.g., within controller 82. Moreover, a temperature derivative (e.g., a change in temperature) may be measured by comparing the first and second temperature signals.

In certain embodiments, the temperature derivative is measured within or during an initial dry cycle. The dry cycle may span or last for a set period from the activation of the heater 43. The set period may thus begin upon initial activation of the heater 43 and end upon transmittal of the second temperature signal from temperature sensor 92. Advantageously, the set time period may ensure that an accurate temperature change is detected. In optional embodiments, the set time period is less than five (5) minutes. For instance, the set period may be less than three (3) minutes.

Figure 5:
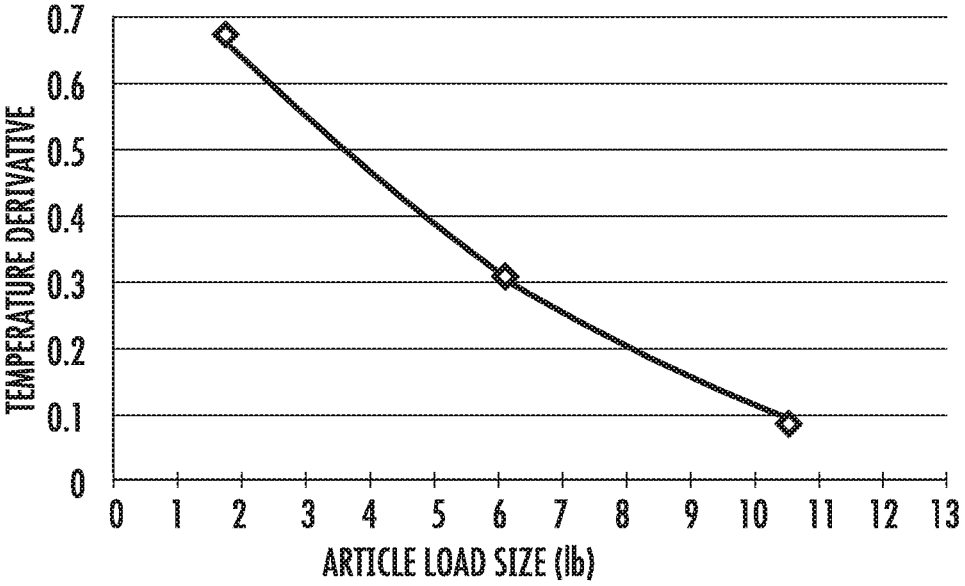
FIG. 5 provides an example predeveloped model establishing a relationship between a temperature derivative value and a probable size of an article load.

Once the temperature derivative is measured, controller 82 may use temperature derivative (e.g., the change in temperature) to generate the secondary appraisal of the article load size. Specifically, controller 82 may compare the temperature derivative to one or more predetermined temperature data. As illustrated in FIG. 5, the predetermined temperature data may establish a relationship between the derivative value and the probable size of the article load (e.g., as a predeveloped database, chart, model, or algorithm tracking a temperature derivative value to an article load size value). For instance, a predeveloped model created through experimentation of a representative appliance (e.g., an appliance of the same size and configuration as appliance 10) may be stored within controller 82. The temperature derivative measured by controller 82 may then correspond to a specific appraised article load size (e.g., article weight).

In some embodiments, the temperature derivative (e.g., temperature change) may further correspond to moisture levels of articles within drum 26. For a certain load size (e.g., appraised or determined load size), a relatively large derivative value may indicate a relatively high moisture level, while a relatively small derivative value may indicate a relatively low moisture level. A predeveloped database, chart, model, or algorithm may be provided that correlates specific derivative values to specific moisture levels. Accordingly, controller 82 may determine a moisture level from the derivative.

Although described individually, it is understood that the primary appraisal and secondary appraisal need not be generated in the order provided. For instance, some of the above-described steps may overlap. Generation of the primary appraisal may occur during at least a portion of the secondary appraisal generation. The primary appraisal and the secondary appraisal may optionally be generated simultaneously. Alternatively, the secondary appraisal may be generated before the primary appraisal. Moreover, the primary appraisal may be generated before the secondary appraisal.

Controller 82 may use one or both of the primary appraisal and the secondary appraisal to determine the article load size. As an example, a predetermined interdependent database or model may be created through experimentation of a representative appliance (e.g., an appliance of the same size and configuration as appliance 10). Moreover, the predetermined interdependent database or model may be stored within controller 82. The primary appraisal value and secondary appraisal value may correspond to specific article load size(s) (e.g., article weight). As a result, a specific primary appraisal value and a specific secondary appraisal may indicate a corresponding article load size.

As an alternative example, controller 82 may determine the mean or average of the primary appraisal and the secondary appraisal. The determined mean may be used as the determination of the article load size.

As a further alternative example, the primary appraisal may conditionally represent the determined article load size. Controller 82 may compare the primary appraisal to the secondary appraisal. If the primary appraisal does not conflict with the secondary appraisal (e.g., diverge from the secondary appraisal by more than a predetermined range or percentage), the primary appraisal may be used as the determined article load size. Optionally, a conflict between the primary appraisal and the secondary appraisal (e.g., a deviation greater than the predetermined range or percentage) may cause controller 82 to signal an error display, message, or signal. Moreover, controller 82 may halt operation of heating assembly 40, air handler 48, and/or motor 31 (e.g., automatically in response to a conflict between the appraisals, or in response to manual intervention input from a user).

After a determination of the article load size is made, controller 82 may direct or control heating assembly 40 accordingly. Specifically, controller 82 may direct the heater 43 to output heat at a certain power level based on the determined article load size. For instance, if an initial power output or level is insufficient according to the determined article load size, power output may be increased. Conversely, if the initial power output is greater than would be suitable according to the determined article load size, power output may be decreased. Advantageously, the controller 82 may adjust the heater 43 to maximize efficiency and minimize unnecessary heat output.

As an example, in embodiments wherein heater 43 includes multiple electrical heating elements, controller 82 may activate one or more of the electrical heating elements according to the determined article load size. Optionally, a load threshold may be provided. If the determined article load size is less than or equal to the load threshold, a first set number of electrical heating elements (e.g., one electrical heating element) are/is activated. If the determined article load size is greater than the load threshold, a second set number of electrical heating elements (e.g., two electrical heating elements) may be activated. In other words, the second set number is greater than the first set number of electrical heating elements. Although a single threshold is described, it is understood that some embodiments (e.g., embodiments having greater than two electrical heating elements) may include multiple load thresholds.

As another example, in embodiments wherein heater 43 includes a variable output gas burner, controller 82 may direct the overall burner output according the determined article load size. Optionally, a load threshold may be provided. If the determined article load size is less than or equal to the load threshold, the burner is directed to output a first heat level [e.g., in British thermal units (Btu) per hour]. If the determined article load size is greater than the load threshold, the burner is directed to output a second heat level that is higher than the first heat level. Although a single threshold is described, it is understood that some embodiments may include multiple load thresholds. Alternatively, an algorithm or model may establish a continuous correlation between determined article load size and the heat level of the burner.

As yet another example, in embodiments wherein heater 43 includes a variable output electrical heating element, controller 82 may direct the overall heating element output according the determined article load size. Optionally, a load threshold may be provided. If the determined article load size is less than or equal to the load threshold, the electrical heating element is directed to output a first heat level (e.g., in watts). If the determined article load size is greater than the load threshold, the electrical heating element is directed to output a second heat level that is greater higher than the first heat level. Although a single threshold is described, it is understood that some embodiments may include multiple load thresholds. Alternatively, an algorithm or model may establish a continuous correlation between determined article load size and the heat level of the electrical heating element.

Figure 6:
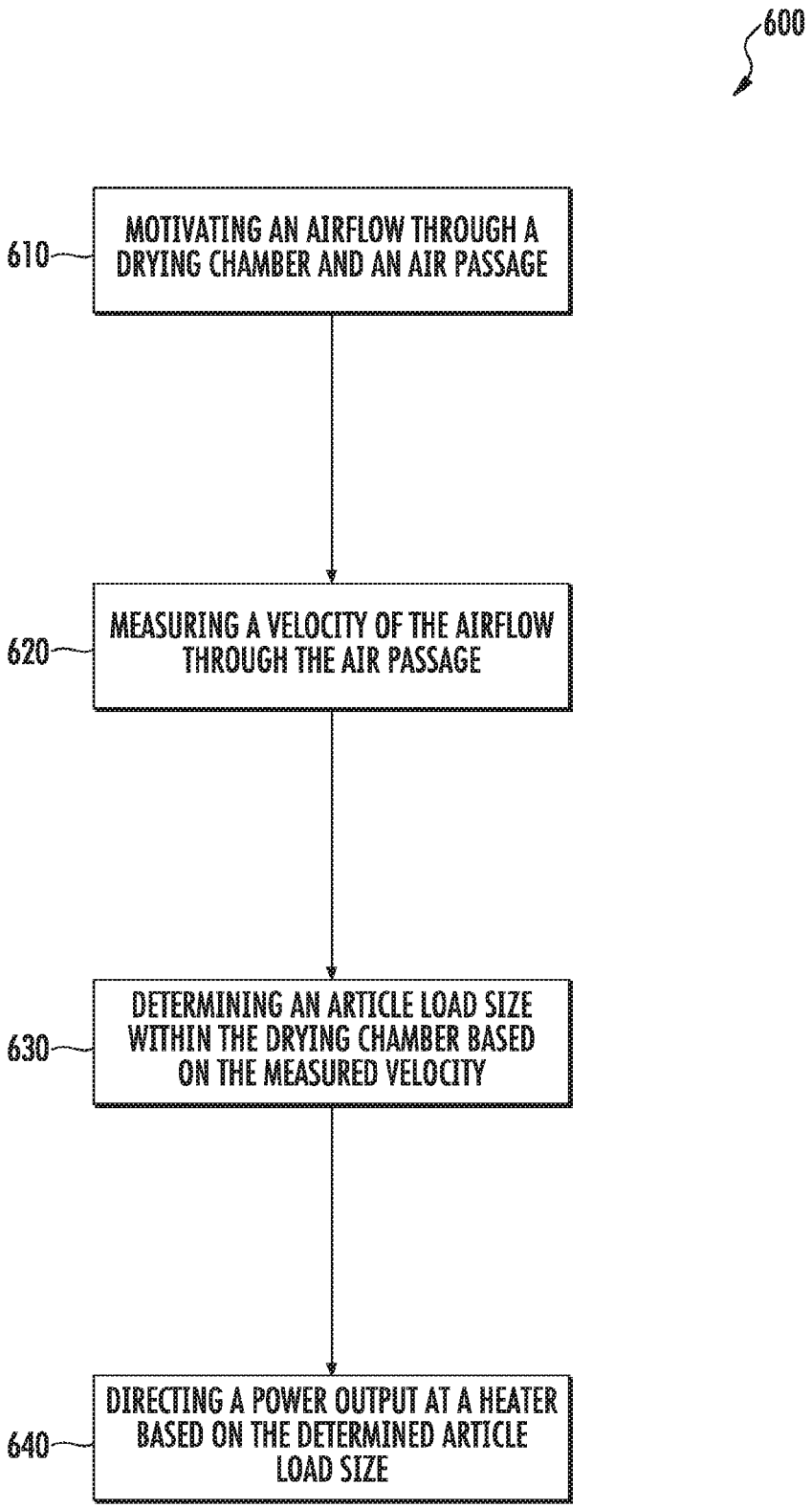
FIG. 6 provides a flow chart illustrating a method of operating a dryer appliance according to example embodiments of the present disclosure.
Figure 7:
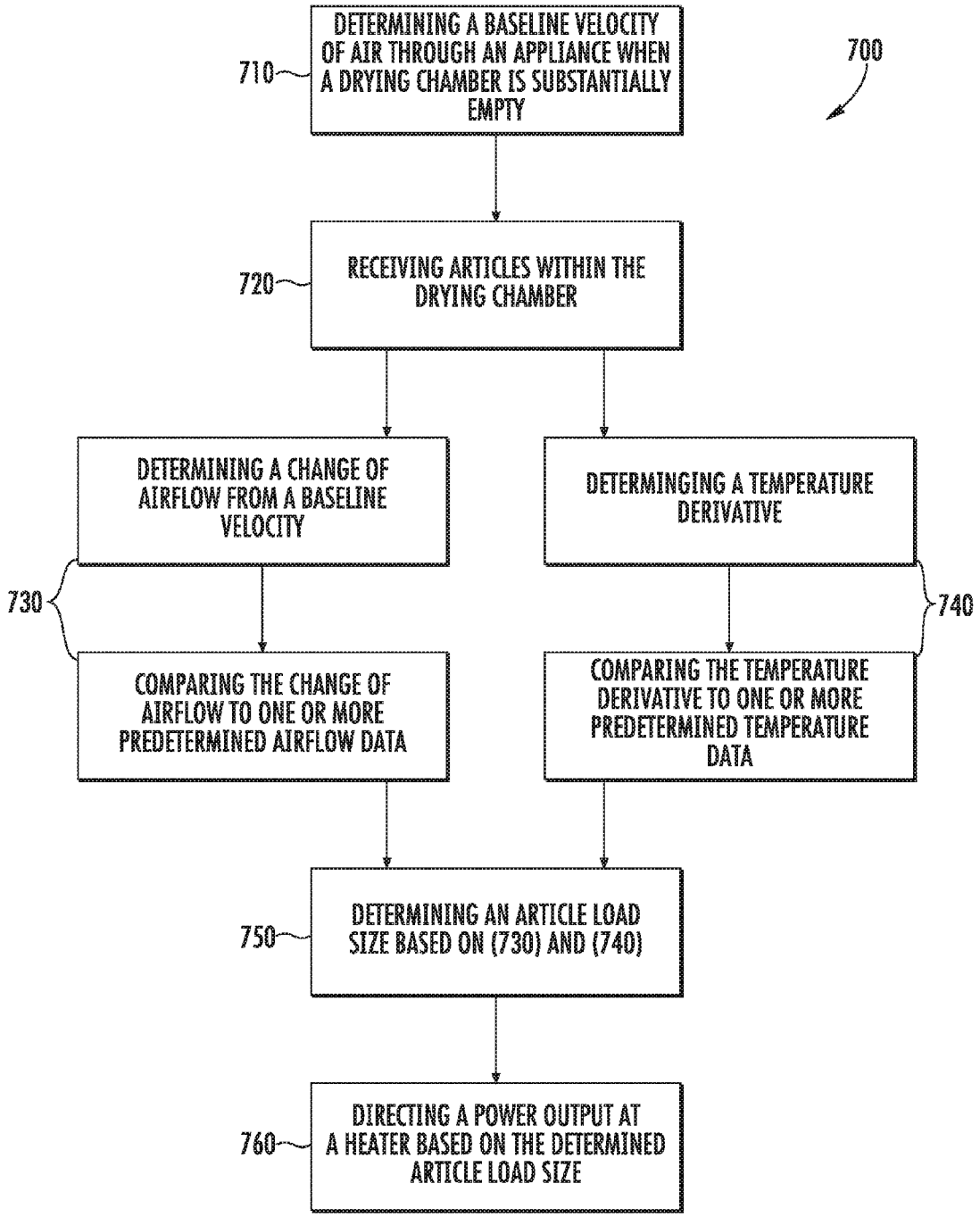
FIG. 7 provides a flow chart illustrating another method of operating a dryer appliance according to example embodiments of the present disclosure.

Turning now to FIGS. 6 and 7, flow diagrams are provided of methods 600 and 700, according to example embodiments of the present disclosure. Generally, the methods 600 and 700 provide methods for controlling a dryer appliance 10 that includes a drying chamber 25, one or more air passages 56, 65, and a heater 43, as described above. Each of the method 600 and the method 700 can be performed, for instance, by the controller 82. For example, controller 82 may, as discussed, be in communication with airflow sensor 90, temperature sensor 92, and/or heater 43. Moreover, controller 82 may send signals to and receive signals from airflow sensor 90, temperature sensor 92, and/or heater 43. Controller 82 may further be in communication with other suitable components of the appliance 10 to facilitate operation of the appliance 10, generally. FIGS. 6 and 7 depict steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Referring to FIG. 6, at 610, the method 600 includes motivating an airflow from the drying chamber and the air passage. Specifically, 610 may include activating the air handler. In turn, the air handler may force air through a heating assembly, including an inlet conduit defining an air entrance passage, and into the drying chamber defined by an appliance drum. From the drying chamber, air handler may further force air through an exhaust conduit defining an air exhaust passage.

At 620, the method 600 includes measuring a velocity of the airflow through the air passage. In some embodiments, an airflow sensor is disposed within the air passage, as described above. As air handler motivates the airflow through the air passage, airflow sensor may detect the velocity of the airflow. Signals from the airflow sensor may be transmitted to and received by the controller. Once airflow signals are received, controller may determine the measured airflow velocity (e.g., as an air flow rate in meters per second, or as a volumetric velocity in cubic meters per second). Optionally, the heater is maintained in an inactive state during 620.

At 630, the method 600 includes determining an article load size within the drying chamber based on the measured velocity. For instance, 630 may include comparing the measured velocity to a baseline velocity. In some such embodiments, 630 includes establishing the baseline velocity as a premeasured airflow through the air passage when the drying chamber is substantially empty (i.e., when no articles for drying are present within the drying chamber). Moreover, comparing the measured velocity to the baseline velocity may include determining a difference between the measured velocity and the baseline velocity. The difference may be matched to a predeveloped database, chart, model, or algorithm that correlates the difference to an article load size value.

In optional embodiments, the method 600 includes measuring a temperature derivative (e.g., temperature change) within the dryer appliance. Specifically, a temperature change may be determined from a temperature sensor disposed within the appliance. In some such embodiments, 630 includes generating a primary appraisal of the article load size based on the measured velocity of 620. Moreover, 630 may include generating a secondary appraisal of the article load size based on the measured temperature derivative or change within the appliance, as described above.

At 640, the method 600 includes directing a power output at or from the heater based on the determined article load size. For instance, power output of the heater may be increased or decreased according to the determined article load size, as described above.

Referring to FIG. 7, at 710, the method 700 includes determining a baseline velocity of air through the appliance when the drying chamber is substantially empty (i.e., when no articles for drying are present within the drying chamber). Specifically, 710 may include activating the air handler before articles are placed within the drum. In turn, the air handler may force air through a heating assembly, including an inlet conduit defining an air entrance passage, and into the drying chamber defined by an appliance drum. From the drying chamber, air handler may further force air through an exhaust conduit defining an air exhaust passage. As air handler motivates the airflow through the appliance, airflow sensor may detect the velocity of the airflow. Signals from the airflow sensor may be transmitted to and received by the controller. Once airflow signals are received, controller may determine the baseline airflow velocity (e.g., as an air flow rate in meters per second, or as a volumetric velocity in cubic meters per second).

At 720, the method 700 includes receiving articles within the drying chamber. Specifically, 720 may occur after 710. Once the baseline velocity is determined, the air handler may be deactivated and door may be opened to permit articles within drying chamber.

At 730, the method 700 includes generating a primary appraisal of the article load size based on the measured velocity. As illustrated, 730 may include determining the change of airflow from a baseline velocity. Specifically, the determination of the change of airflow may be made by measuring a second airflow velocity through the appliance. Measuring may include activating the air handler after articles are placed within the drum. In turn, the air handler may force air through a heating assembly, including an inlet conduit defining an air entrance passage, and into the drying chamber defined by an appliance drum. From the drying chamber, air handler may further force air through an exhaust conduit defining an air exhaust passage. As air handler motivates the airflow through the appliance, airflow sensor may detect the velocity of the airflow. Signals from the airflow sensor may be transmitted to and received by the controller. Once airflow signals are received, controller may determine the measured airflow velocity (e.g., as an air flow rate in meters per second, or as a volumetric velocity in cubic meters per second). After measuring the airflow velocity, 730 may include comparing the baseline velocity to the measured (i.e., second) velocity to obtain a difference value.

Furthermore, 730 may include comparing the change of airflow (i.e., the difference value) to one or more predetermined airflow data to obtain a primary appraisal. As described above, the predetermined airflow data may establish a relationship between the difference value and the probable size of the article load (e.g., as a predeveloped database, chart, model, or algorithm tracking an airflow difference value to an article load size value). Optionally, the heater is maintained in an inactive state during 730.

At 740, the method 700 includes generating a secondary appraisal of the article load size based on a measured temperature derivative. As shown, 740 may include determining a temperature derivative, such as by measuring a change in temperature. The change in temperature may be obtained at a temperature sensor, as described above. Moreover, 740 may further include comparing the temperature derivative to one or more predetermined temperature data to obtain a secondary appraisal. As described above, the predetermined temperature data may establish a relationship between the temperature derivative and the probable size of the article load (e.g., as a predeveloped database, chart, model, or algorithm tracking a temperature derivative value to an article load size value).

Optionally, 740 may occur during at least a portion of the 730. Alternatively, 740 may occur before 730. Moreover, 730 may occur before 740. In certain embodiments, method 700 includes activating the heater for an initial dry cycle that last for a set period of time (e.g., five minute or three minutes). Optionally, 740 may occur within the set period of time. In turn, 740 may obtain the measured temperature less than five minutes after activating the heater.

At 750, the method 700 includes determining the article load size based on 730 and 740 (i.e., based on the primary appraisal and the secondary appraisal). Specifically, 750 may include comparing the primary appraisal and the secondary appraisal. Optionally, the primary and secondary appraisals may be compared through a predetermined interdependent database correlating appraisal values to specific article load size(s) (e.g., article weight). Alternatively, the primary and secondary appraisals may be averaged to obtain the determined article load size. Additionally or alternatively, the primary appraisal may be conditionally adopted to represent the determined article load size, as described above.

At 760, the method 700 includes directing a power output at or from the heater based on the determined article load size. For instance, power output of the heater may be increased or decreased according to the determined article load size, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling a dryer appliance, the dryer appliance including a drying chamber, an air passage in fluid communication with the drying chamber, and a heater in thermal communication with the drying chamber, the method comprising:

with the heater inactive motivating an airflow through the drying chamber and the air passage;

measuring a velocity of the airflow through the air passage, wherein the heater is maintained in an inactive state during measuring the velocity of airflow;

measuring a temperature derivative within the dryer appliance;

determining an article load size within the drying chamber based on the measured velocity; and directing a power output at the heater to activate the heater based on the determined article load size, wherein determining the article load size comprises generating a primary appraisal of the article load size based on the measured velocity, generating a secondary appraisal of the article load size based on the measured temperature derivative within the appliance, and assigning the determined articled load size according to the primary appraisal and the secondary appraisal.

2. The method of claim 1, wherein determining an article load size includes comparing the measured velocity to a baseline velocity.

3. The method of claim 2, further comprising establishing the baseline velocity as a premeasured airflow through the air passage when the drying chamber is empty.

4. The method of claim 2, wherein comparing the measured velocity to the baseline velocity includes determining a difference between the measured velocity and the baseline velocity, and wherein the difference is matched to a predeveloped model correlating the difference to an article load size value.

5. The method of claim 1, further comprising activating the heater for an initial dry cycle, wherein the measured temperature derivative is obtained less than five minutes after activating the heater.

6. The method of claim 1, wherein determining the article load size comprises comparing the primary appraisal to the secondary appraisal.

7. The method of claim 6, wherein generating the primary appraisal occurs before generating the secondary appraisal.

8. The method of claim 6, wherein generating the primary appraisal occurs during at least a portion of generating the secondary appraisal.

9. A dryer appliance comprising:

a cabinet;

a drum rotatably mounted within the cabinet, the drum defining a drying chamber;

an air passage in fluid communication with the drying chamber;

an air handler attached in fluid communication with the drying chamber to motivate an airflow therethrough;

a heating assembly attached to the drum in thermal communication with the drying chamber;

an airflow sensor disposed in fluid communication with the air passage to detect the airflow; and a controller operatively connected to the air handler, the heating assembly, and the airflow sensor, the controller being configured to initiate a load-contingent cycle, the load-contingent cycle comprising with the heating assembly inactive, motivating an airflow through the drying chamber and the air passage, measuring a velocity of the airflow through the air passage from the airflow sensor, wherein the heating assembly is maintained in an inactive state during measuring the velocity of airflow, measuring a temperature derivative within the dryer appliance, determining an article load size within the drying chamber based on the measured velocity, and directing a power output at the heating assembly to active the heating assembly based on the determined article load, wherein determining the article load size comprises generating a primary appraisal of the article load size based on the measured velocity, generating a secondary appraisal of the article load size based on the measured temperature derivative within the appliance, and assigning the determined articled load size according to the primary appraisal and the secondary appraisal.

10. The dryer appliance of claim 9, wherein determining an article load size includes comparing the measured velocity to a baseline velocity.

11. The dryer appliance of claim 10, wherein the load-contingent cycle further comprises establishing the baseline velocity as a premeasured airflow through the air passage at the airflow sensor when the drying chamber is empty.

12. The dryer appliance of claim 10, wherein comparing the measured velocity to the baseline velocity comprises determining a difference between the measured velocity and the baseline velocity, and wherein the difference is matched to a predeveloped model correlating the difference to an article load size value.

13. The dryer appliance of claim 9, wherein the load-contingent cycle further comprising activating the heating assembly for an initial dry cycle, and wherein the measured temperature derivative is obtained less than five minutes after activating the heating assembly.

14. The dryer appliance of claim 9, wherein determining the article load size comprises comparing the primary appraisal to the secondary appraisal.

15. The dryer appliance of claim 14, wherein generating the primary appraisal occurs before generating the secondary appraisal.

16. The dryer appliance of claim 14, wherein generating the primary appraisal occurs during at least a portion of generating the secondary appraisal.

* * * * *